US007685678B2

(12) United States Patent
Moon et al.

(10) Patent No.: US 7,685,678 B2
(45) Date of Patent: Mar. 30, 2010

(54) REFRIGERATOR HAVING HEIGHT-ADJUSTABLE DOOR

(75) Inventors: Sun Nam Moon, Sancheong-gun (KR); Myung Soo Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 11/406,238

(22) Filed: Apr. 19, 2006

(65) Prior Publication Data

US 2006/0244351 A1 Nov. 2, 2006

(30) Foreign Application Priority Data

Apr. 22, 2005 (KR) ..... 10-2005-0033688
Apr. 22, 2005 (KR) ..... 10-2005-0033689
May 10, 2005 (KR) ..... 10-2005-0038714
Jun. 2, 2005 (KR) ..... 10-2005-0047418

(51) Int. Cl.
*E05D 7/04* (2006.01)

(52) U.S. Cl. ..... 16/243; 16/245

(58) Field of Classification Search ..... 16/242, 16/243, 235, 245, 246, 239, 240, 248; 312/312, 312/326

See application file for complete search history.

(56) References Cited

U.S. PATENT DOCUMENTS 2,334,086 A * 11/1943 Greiner ..... 180/20
3,059,289 A 10/1962 Roland
3,670,357 A 6/1972 Steigerwald
3,683,453 A * 8/1972 McLeland et al. ..... 16/248
3,866,658 A * 2/1975 Smith ..... 160/206
4,070,728 A 1/1978 Herman
4,109,346 A * 8/1978 Strozier ..... 16/235
4,181,037 A * 1/1980 Boon et al. ..... 74/569
4,215,449 A * 8/1980 Loikitz ..... 16/50
4,932,729 A * 6/1990 Thompson et al. ..... 312/405
5,018,777 A 5/1991 Swenson et al.
5,215,367 A * 6/1993 Montuoro et al. ..... 312/401
5,548,869 A * 8/1996 Ryczek ..... 16/93 R
5,788,351 A * 8/1998 Prunty et al. ..... 312/326
7,490,384 B2 * 2/2009 Lee ..... 16/244

FOREIGN PATENT DOCUMENTS

EP 403928 A1 * 12/1990
EP 1278033 A1 * 1/2003
KR 20-2002-0005973 2/2002

* cited by examiner

*Primary Examiner*—Victor Batson
*Assistant Examiner*—Matthew Sullivan
(74) *Attorney, Agent, or Firm*—KED & Associates, LLP

(57) ABSTRACT

Disclosed is a refrigerator having a height-adjustable door. The body of the refrigerator has at least one storage space having a front opening. The door is coupled to the body so as to cover/uncover the storage space, and a hinge hole is formed on the bottom surface of the door. A hinge frame is fixed to a front surface of a lower portion of the body and has a hinge shaft inserted into the hinge hole so as to rotatably support the door. The hinge shaft is covered with a hinge bush, a part of which is inserted into the hinge hole. The hinge bush has a flange portion on its lower end for supporting the bottom surface of the door. A height adjustment screw is screw-coupled to a screw hole of the hinge frame so as to travel vertically. The upper end of the height adjustment screw abuts the bottom surface of the hinge bush so that, when rotated, the height adjustment screw lifts/lowers the hinge bush, in order to adjust the height of the door.

14 Claims, 12 Drawing Sheets

REFRIGERATOR HAVING HEIGHT-ADJUSTABLE DOOR

BACKGROUND OF THE INVENTION

1. Field of the Invention

The present invention relates to a refrigerator having a height-adjustable door, and more particularly to a refrigerator having a height-adjustable door, the height of which can be adjusted easily.

2. Description of the Prior Art

FIG. 1 is a perspective view showing the structure of a conventional side-by-side type refrigerator. FIG. 2 is a sectional view showing a support structure for rotatably supporting a door of a refrigerator according to the prior art.

Referring to FIG. 1, the conventional refrigerator includes a body 10 provided with freezing and refrigerating chambers 11 and 12, which have front openings, and freezing and refrigerating chamber doors 21 and 22 for covering/uncovering the front openings of the freezing and refrigerating chambers 11 and 12, respectively. The freezing and refrigerating chamber doors 21 and 22 are rotatably supported on the upper and lower ends of both sides of the body so that the freezing and refrigerating chambers are covered/uncovered.

A conventional structure for supporting the doors 21 and 22 will now be described with reference to FIG. 2. The doors 21 and 22 are supported so as to rotate relative to the body 10, in order to cover/uncover the front openings of the freezing and refrigerating chamber 11 and 12. The doors 21 and 22 have hinge holes 23 formed on their bottom surfaces in the longitudinal direction. The body 10 has hinge frames 31 fixed to its lower end and hinge shafts 31*a* positioned on the hinge frames 31 so that the hinge shafts 31*a* are inserted into the hinge holes 23 and rotatably support the doors 21 and 22.

The hinge frames 31 are fixed to the body 10 with bolts or by welding, for example, and have hinge bushes 32 fitted to the hinge shafts 31*a*. Particularly, the hinge bushes 32 are configured so as to enclose the hinge shafts 31*a* and have rotation shafts 32*a*, which are inserted into the hinge holes 23 and rotatably support the doors 21 and 22 directly.

The upper ends of the doors are similarly supported by hinge devices (not shown) so that the doors can rotate. It can be easily understood by those skilled in the art that the hinge devices (not shown) for supporting the upper ends of the doors do not bear the weight of the doors, but simply provide shafts for rotation of the doors, while the hinge frames 31, shown in the drawing, directly bear the weight of the doors.

Such a conventional refrigerator has a problem in that the freezing and refrigerating doors 21 and 22 may not be completely level with each other due to an assembly tolerance, or they may be displaced downwards by repeated opening/closing operations. This results in a discrepancy in height between the doors 21 and 22.

In order to remove such a discrepancy in height, the doors 21 and 22 must be completely separated from the body 10 and the hinge frames 31 must be repositioned in an inefficient and inconvenient manner, because the height of the doors 21 and 22 are determined in the initial assembly process.

SUMMARY OF THE INVENTION

Accordingly, the present invention has been made to solve the above-mentioned problems occurring in the prior art, and an object of the present invention is to provide a refrigerator having a height-adjustable door, the height of which can be adjusted easily.

Another object of the present invention is to provide a refrigerator having a door, the position of which can be maintained accurately.

In order to accomplish these objects, according to the basic technical idea of the present invention, an adjustment bolt, which has a thread formed on its outer peripheral edge, is screw-coupled to a screw hole, which is formed on a plate-shaped member, so that the height of a door can be adjusted by rotating the adjustment bolt for its upward/downward movement.

In accordance with an aspect of the present invention, there is provided a refrigerator having a height-adjustable door including a body having at least one storage space having a front opening; a door coupled to the body so as to cover/uncover the storage space, a hinge hole being formed on a bottom surface of the door; a hinge frame fixed to a front surface of a lower portion of the body, the hinge frame having a hinge shaft inserted into the hinge hole so as to rotatably support the door; a hinge bush interposed between the hinge frame and the door; and a lifting/lowering means supported on the hinge frame and adapted to lift/lower the hinge bush so that the door is lifted/lowered.

Preferably, the lifting/lowering means has a height adjustment screw screw-coupled to a screw hole of the hinge frame, and an upper end of the height adjustment screw abuts a bottom surface of the hinge bush and lifts/lowers the hinge bush when the height adjustment screw is rotated.

Preferably, the hinge bush has a stem portion fitted into the hinge hole, the stem portion being hollow so that the hinge shaft is inserted into the stem portion from below, and a flange portion extending from a lower end of the stem portion in a radial direction and abutting the bottom surface of the door.

Preferably, a flange portion extends from the upper end of the height adjustment screw in a radial direction.

Preferably, a receiving hole is formed on a bottom surface of the hinge bush and receives the flange portion.

Preferably, the hinge frame has a fixing portion fixed to the front surface of the body and a support portion extending forwards from an upper end of the fixing portion, and the hinge shaft is positioned on the support portion.

In accordance with another aspect of the present invention, there is provided a refrigerator having a height-adjustable door including a body having at least one storage space having a front opening; a door coupled to the body so as to cover/uncover the storage space, a hinge hole being formed on a bottom surface of the door; a hinge frame fixed to a front surface of a lower portion of the body, the hinge frame having a hinge shaft inserted into the hinge hole so as to rotatably support the door; a door support plate inserted into the hinge shaft and adapted to abut the bottom surface of the door; and a height adjustment screw screw-coupled to the hinge frame in a position corresponding to a lower portion of the door support plate, the height adjustment screw being adapted to travel upwards/downwards when rotated so that the door support plate is lifted/lowered.

Preferably, a plurality of washers are fitted to the hinge shaft between the door support plate and the hinge frame.

Preferably, the hinge frame has a fixing portion fixed to the front surface of the lower portion of the body and a support portion extending forwards from an upper end of the fixing portion, the hinge shaft is positioned on the support portion, and the height adjustment screw is screw-coupled to the support portion.

Preferably, a hole is formed on a bottom surface of the door support plate and receives an upper end of the height adjustment screw.

In accordance with another aspect of the present invention, there is provided a refrigerator having a height-adjustable door including a body having at least one storage space having a front opening; a door coupled to the body so as to cover/uncover the storage space, a hinge hole being formed on a bottom surface of the door; a hinge frame fixed to a front surface of a lower portion of the body so as to bear weight of the door; a height adjustment plate supported on the hinge frame, the height adjustment plate having a hinge shaft inserted into the hinge hole so as to rotatably support the door; and a lifting/lowering means for lifting/lowering the height adjustment plate with an upper end of the lifting/lowering means extending through the hinge frame.

Preferably, the lifting/lowering means includes a lift portion adapted to abut a bottom surface of the height adjustment plate with an upper end of the lift portion extending through the hinge frame, a thread being formed on an outer peripheral edge of the lift portion in a direction; a support leg portion coaxially positioned with a predetermined spacing from the lift portion, a thread being formed on an outer peripheral edge of the support leg portion in a direction opposite to the direction of the thread of the lift portion; and a lift block at least partially screw-coupled to the lift portion and the support leg portion, threads being formed on an inner peripheral edge of the lift block so as to be screw-coupled to the threads of the lift portion and the support leg portion, respectively.

Preferably, a support protrusion extends downwards from the bottom surface of the height adjustment plate, and an insertion hole is formed on the hinge frame so that the support protrusion is inserted into the insertion hole.

Preferably, the hinge frame has a fixing portion fixed to the front surface of the lower portion of the body and a support portion extending forwards from an upper end of the fixing portion, and the hinge shaft is positioned on the support portion.

In accordance with another aspect of the present invention, there is provided a refrigerator having a height-adjustable door including a body having at least one storage space having a front opening; a door coupled to the body so as to cover/uncover the storage space, a hinge hole being formed on a bottom surface of the door; a fixing socket fixed to a front surface of a lower portion of the body and provided with a pocket portion having an upper opening; a hinge bracket having a fixing portion extending vertically to be inserted into the pocket portion and a support portion extending forwards from an upper end of the fixing portion, a hinge shaft being formed on an upper surface of the support portion to be coupled to the hinge hole of the door; a lifting/lowering means for lifting/lowering the hinge bracket; and a fixing means for fixing the hinge bracket after position adjustment using the lifting/lowering means.

Preferably, the lifting/lowering means includes a height adjustment plate extending forwards from the fixing portion of the hinge bracket; a fixing piece extending forwards from a front surface of the fixing socket in a position corresponding to a lower portion of the height adjustment plate, the fixing piece having a screw hole having a threaded inner peripheral edge; and an adjustment screw screw-coupled to the screw hole of the fixing piece, an upper end of the adjustment screw abutting a bottom surface of the height adjustment plate, the height adjustment plate being exposed forwards via a cutout formed on the front surface of the fixing socket, the cutout extending a predetermined distance vertically, so that the height adjustment plate is moved vertically by the adjustment screw.

Preferably, the fixing means includes a number of fastening bolts screw-coupled to a front portion so as to extend to an inner portion of the pocket portion, the front portion defining a front surface of the pocket portion, and rear ends of the fastening bolts force the hinge bracket against a rear surface of the inner portion of the pocket portion and fix the hinge bracket to the rear surface.

Alternatively, the fixing means includes a number of fixing holes formed on a front portion defining a front surface of the pocket portion; a number of fastening holes formed on a rear portion of the pocket portion in a position corresponding to the fixing holes, the fastening holes having threaded inner peripheral edges; guide holes formed on the hinge bracket so as to extend vertically; and fastening bolts fastened to the fastening holes so as to fix the hinge bracket inside the pocket portion, the fastening bolts extending through the fixing holes and the guide holes.

Preferably, the hinge bracket has a fixing portion received by the pocket portion and a support portion extending forwards from an upper end of the fixing portion, and the hinge shaft is positioned on the support portion.

The present invention is advantageous in that the height of a door of a refrigerator can be adjusted easily. Particularly, in the case of a side-by-side type refrigerator, the height of one of refrigerating and freezing chambers door can be easily adjusted, when it is displaced downwards, so that they are level with each other.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
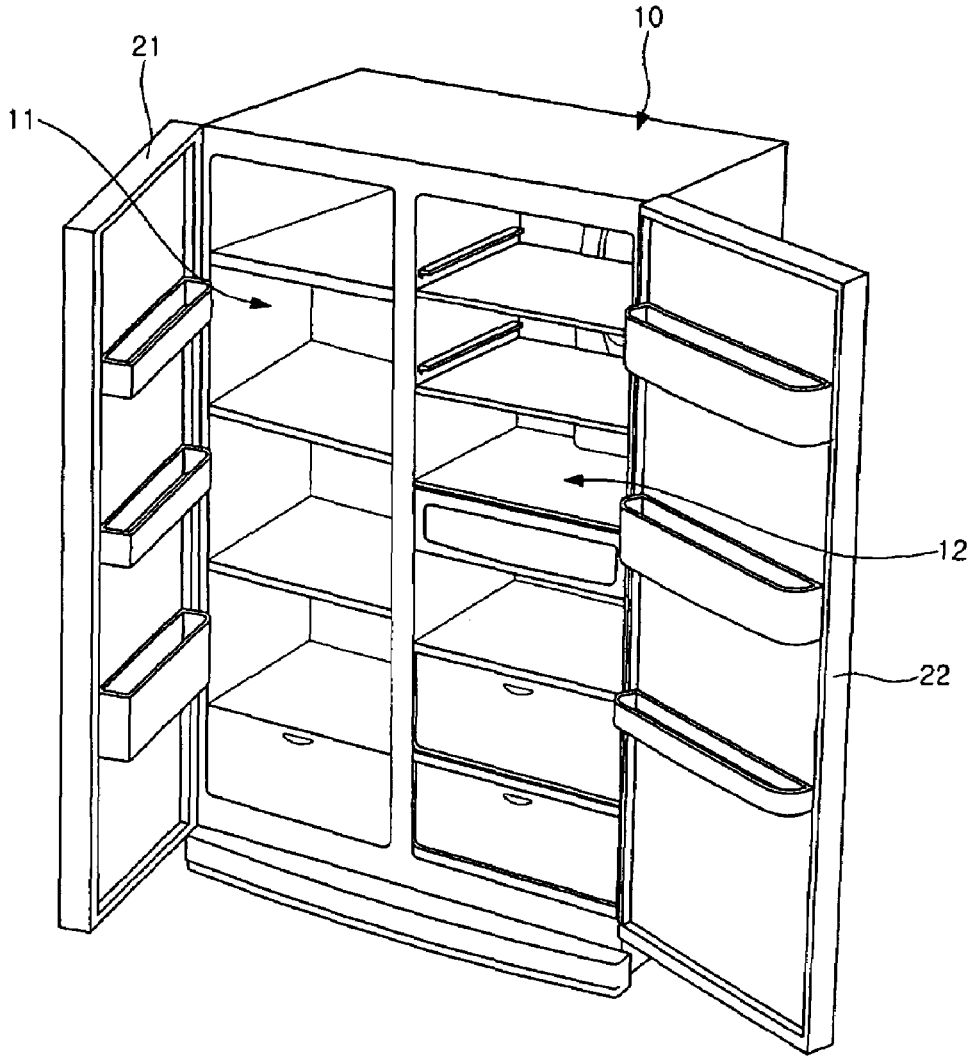
FIG. 1 is a perspective view showing the structure of a conventional refrigerator.
Figure 2:
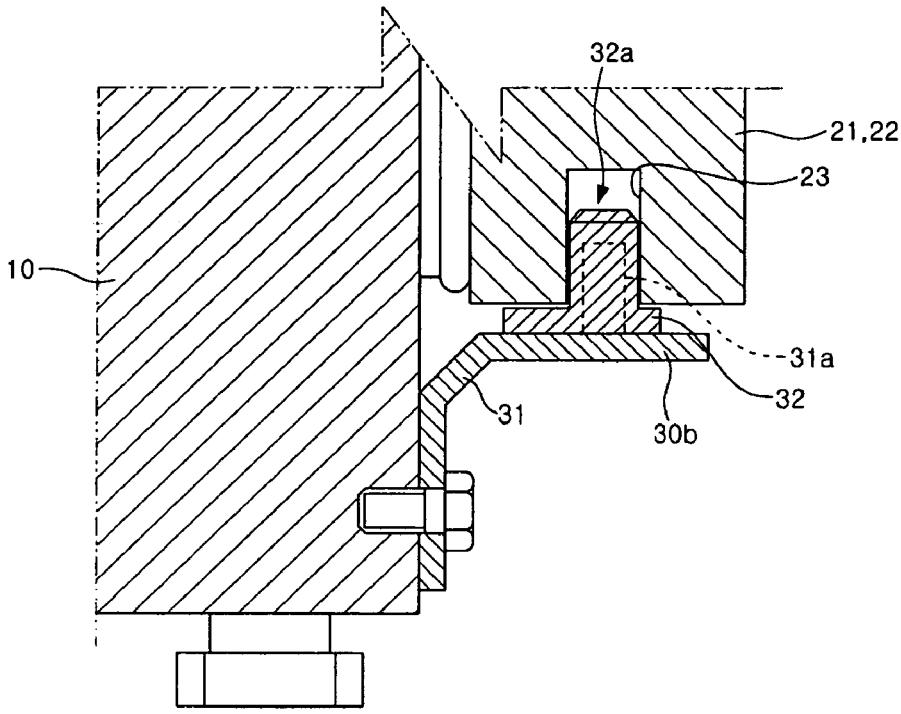
FIG. 2 is a sectional view showing a hinge structure for a door of the conventional refrigerator.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3:
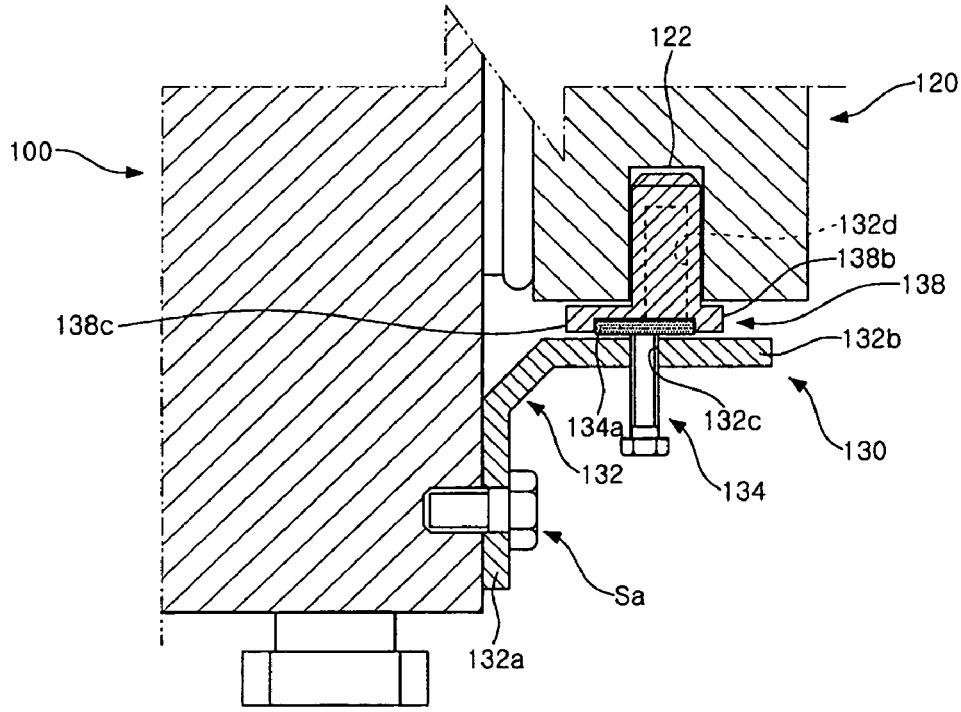
FIG. 3 is a sectional view showing a hinge structure for a door of a refrigerator having a height-adjustable door according to a first embodiment of the present invention.
Figure 4:
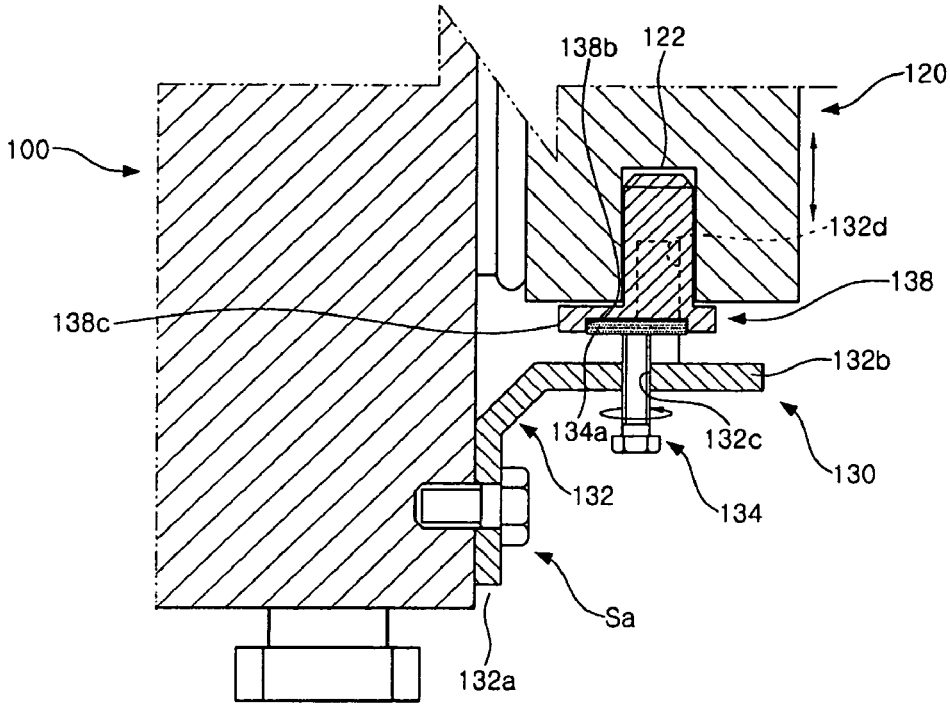
FIG. 4 is a sectional view showing a refrigerator having a height-adjustable door according to the first embodiment of the present invention, when the height of the door has been adjusted by a height adjustment bolt.

FIGS. 3 and 4 are partial sectional views showing a refrigerator having a height-adjustable door according to the present invention.

Referring to FIGS. 3 and 4, a refrigerator having a height-adjustable door according to a first embodiment of the present invention includes a body having at least one storage space, a door 120 supported on the body 100 so as to cover/uncover the storage space, and a hinge device 130 for supporting the door 120 and adjusting its height.

The storage space of the body 100, which is a refrigerating or freezing chamber, for example, has a front opening. The door 120 is rotatably supported on the body 100 so that the storage space of the body 100 is covered/uncovered. The door 120 has a hinge hole 122 formed on its bottom surface in the vertical direction.

The hinge device 130 according to the present embodiment supports the door 120 so that it can rotate relative to the body 100. In addition, the hinge device 130 is configured in such a manner that the height of the door 120 can be adjusted. The hinge device 130 includes a hinge frame 132 fixed to the body 100 so as to bear the weight of the door 120, a height adjustment screw 134 screw-coupled to one side of the hinge frame 130, and a hinge bush 138 adapted to move vertically by means of the height adjustment screw 134.

The hinge frame 132 has a fixing portion 132*a* fixed to a front surface of the lower end of the body 100 and a support portion 132*b* extending forwards from the upper end of the fixing portion 132 in an approximately horizontal direction. The fixing and support portions 132*a* and 132*b* are made of a metallic material capable of bearing the weight of the door 120. The fixing portion 132 is fixed to the front surface of the body 100 by a fixing screw or fixing bolt Sa, for example. The support portion 132*b*, which is integral with the fixing portion 132*a*, extends forwards from the upper end of the fixing portion 132*a* in the horizontal direction. A screw hole 132*c* is formed at the center of the support portion 132*b* and has a threaded inner peripheral edge. A hinge shaft 132*d* is positioned on top of the support portion 132*b* and extends a predetermined length in the upward direction.

The height adjustment screw 134 is screw-coupled to the screw hole 132*c*. The height adjustment screw 134 has a threaded outer peripheral edge so that it can be screw-coupled to the screw hole 132*c* and move vertically when rotated. The height adjustment screw 134 has a flange portion 134*a* formed on its upper end so as to extend in the radial direction, in order to support the hinge bush 138 more stably.

The hinge bush 138 is coupled to the hinge shaft 132*d* of the hinge frame 130. Particularly, the hinge bush 138 is inserted into the hinge hole 122, which is formed on the bottom surface of the door 120, so that the door 120 is rotatably supported.

The hinge bush 138 includes a stem portion 138*a* inserted into the hinge hole 122 and a flange portion 138*c* extending from the lower end of the stem portion 138*a* in the radial direction. The stem portion 138*a* is hollow and has a downward opening so that the hinge shaft 132*d* is inserted therein. The stem portion 138*a* is inserted into the hinge hole 122 and rotatably supports the door 120. The flange portion 138*c* extends in the radial direction so that it is fastened to the bottom surface of the door 120, and the upper end of the height adjustment screw 134 abuts the lower surface of the flange portion 138*c*. The hinge bush 138 acts as a rotation shaft, when the door 120 rotates, and is preferably made of a synthetic resin having a predetermined strength, in order to prevent noise resulting from friction caused by rotation of the door 120.

The hinge bush 138 has a receiving hole 138*b* formed on its bottom surface so as to receive the flange portion 134*a* of the height adjustment screw 134. The flange portion 134*a*, which is inserted into and coupled to the receiving hole 138*b*, stably supports the hinge bush 138 when the height adjustment screw 134 is rotated and moved in the upward or downward direction. Particularly, the receiving hole 138*b* is formed on the bottom surface of the flange portion 138*c*, which extends from the lower end of the hinge bush 138 in the radial direction. The flange portion 138*c* of the hinge bush 138 supports the door 120 while abutting its bottom surface.

A process for adjusting the height of the door 100 according to the present embodiment, which is constructed as above, will now be described.

In general, there may be a discrepancy in height between doors of a refrigerator, due to an assembly tolerance occurring in the production line, for example. Such a discrepancy will become more noticeable in the case of a side-by-side type refrigerator, which has freezing and refrigerating chambers placed side by side.

According to the present invention, the height of the door 120 can be adjusted in a predetermined range, even after the door 120 is assembled to the body 100 of the refrigerator. The height adjustment of the door 120 is performed by rotating the height adjustment screw 134 in a direction. Particularly, rotation of the height adjustment screw 134 in a direction causes it to move a predetermined distance upwards or downwards, due to the interaction with the screw hole 132*c* of the hinge frame 132, which is screw-coupled to the height adjustment screw 134. Those skilled in the art can easily understand that such an upward or downward movement of the height adjustment screw 134 will be reflected by an upward or downward movement of the door 120 via the hinge bush 138.

In FIG. 3, the door 120 is shown in a position lower than in the case of FIG. 4. Particularly, when the door 120 is displaced a distance in the downward direction as shown in FIG. 3, the height adjustment screw 134 is rotated for height adjustment. As a result, the door 120 is moved upwards into a position as shown in FIG. 4.

The flange portion 134*a*, which is formed on the upper end of the height adjustment screw 134, remains to be inserted into the receiving hole 138*b* on the bottom surface of the hinge bush 138, when the door 120 is moved upwards/downwards, and guarantees a large contact area between the flange portion 134*a* and the hinge bush 138. This stably supports the door 120 while it is moved upwards/downwards.

According to the present embodiment, in summary, the height adjustment screw 134, which is screw-coupled to the hinge frame 132, is used to adjust the height of the door 120.

This makes it possible to adjust the door 120, when it is displaced downwards due to an assembly tolerance or repeated opening/closing operations. Particularly, in the case of a side-by-side type refrigerator, a discrepancy in height between refrigerating and freezing chamber doors can be removed easily.

A second embodiment of the present invention will now be described.

Figure 5:
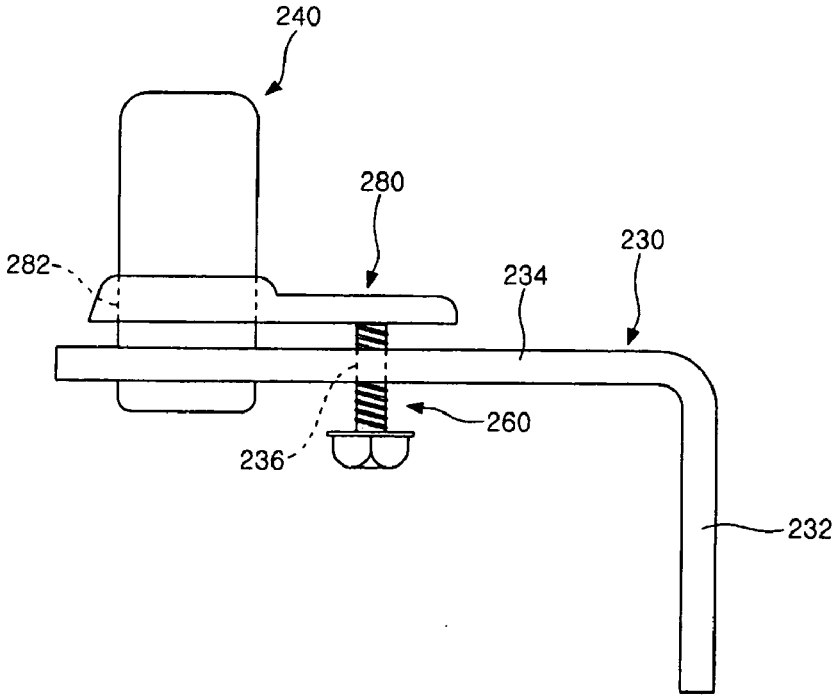
FIG. 5 is a lateral view showing a hinge device according to a second embodiment of the present invention.

FIG. 5 is a lateral view showing a hinge device for adjusting the height of a door according to the second embodiment of the present invention. Referring to FIG. 5, the hinge device according to the present embodiment includes a hinge frame 230 fixed to the lower end of the body of a refrigerator. The hinge frame 230 has a fixing portion 232 fixed to the front surface of the lower end of the body and a support portion 234 extending forwards from the upper end of the fixing portion 232 in an approximately horizontal direction. The fixing portion 232 is fixed to the front surface of the refrigerator by a fixing screw or fixing bolt so that the support portion 234 rotatably supports the door of the refrigerator, as in the case of the above-mentioned first embodiment.

The support portion 234 of the hinge frame 230 has a hinge shaft 240 and a screw hole 236. The hinge shaft 240 is fixed to the support portion 234 of the hinge frame 230 and inserted into a hinge hole (not shown) formed on the bottom surface of the door so that the door is rotatably supported. The top of the hinge shaft 240 is covered with a hinge bush (not shown), which is inserted into the hinge hole of the door and rotatably supports it, as in the case of the first embodiment. The screw hole 236 has a threaded inner peripheral edge, which is screw-coupled to a height adjustment screw 260. Particularly, the height adjustment screw 260 has a threaded outer peripheral edge, which is screw-coupled to the threaded inner peripheral edge of the screw hole 236. When the height adjustment screw 260 is rotated in a direction, it travels upwards or downwards in a predetermined range relative to the support portion 234 of the hinge frame 230, which remains stationary.

The hinge shaft 240 is integrally formed with the support portion 234 or is completely fixed thereto by welding, for example. The hinge shaft 240 has a cylindrical shape and is fitted into the hinge hole on the bottom surface of the door, in order to rotatably support it.

A door support plate 280 is fitted to the hinge shaft 240 so that it can travel upwards or downwards in a predetermined range. The door support plate 280 has a planar shape and has a through-hole 282 formed thereon, through which the hinge shaft 240 extends. The door support plate 280 is configured to abut the bottom surface of the door.

The height adjustment screw 260 is coupled to the screw hole 236 of the support portion 234 from below. The height adjustment screw 260 has a thread formed on the outer peripheral surface of its body so that it can be screw-coupled to the threaded inner peripheral edge of the screw hole 236. The height adjustment screw 260 abuts the bottom surface of the door support plate 280 so that, when the height adjustment screw 260 is moved in the upward or downward direction, the door support plate 280 travels together in the same direction.

Figure 6A:
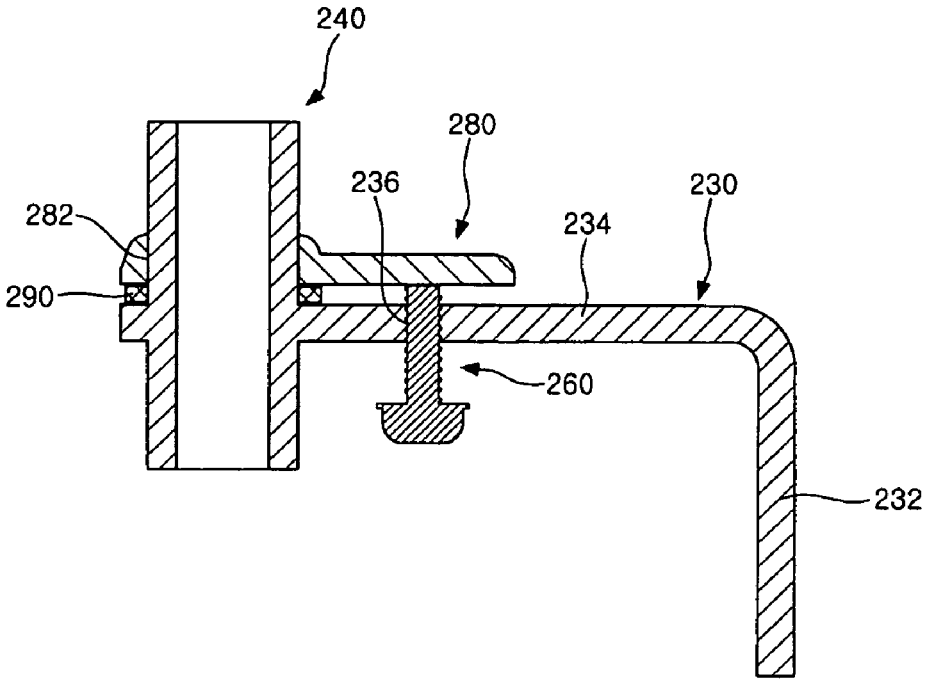
FIG. 6*a* is a lateral view showing an example of a height adjustment process according to the second embodiment of the present invention.
Figure 6B:
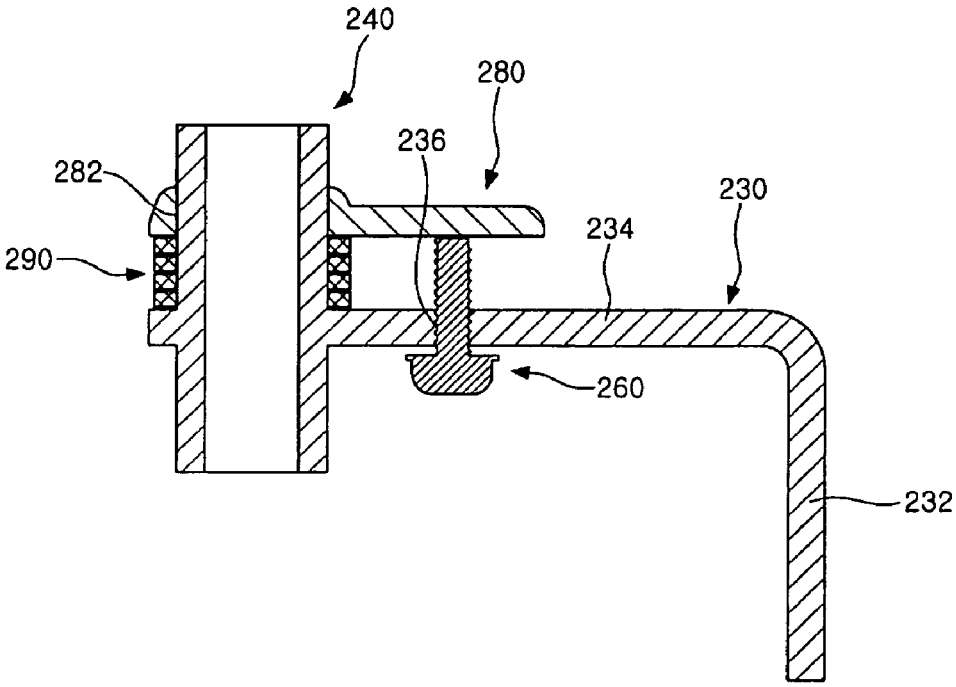
FIG. 6*b* is a lateral view showing another example of a height adjustment process according to the second embodiment of the present invention.

Referring to FIGS. 6*a* and 6*b*, a washer 290 is interposed between the support portion 234 of the hinge frame 230 and the door support plate 280. Particularly, the rear side of the door support plate 280 is supported by the height adjustment screw 260, and the front side thereof is supported by a number of washers 290, which are fitted between the hinge frame 230 and the door support plate 280. As such, the door support plate 280 can stably support the door, which abuts the top of the door support plate 280.

Figure 7:
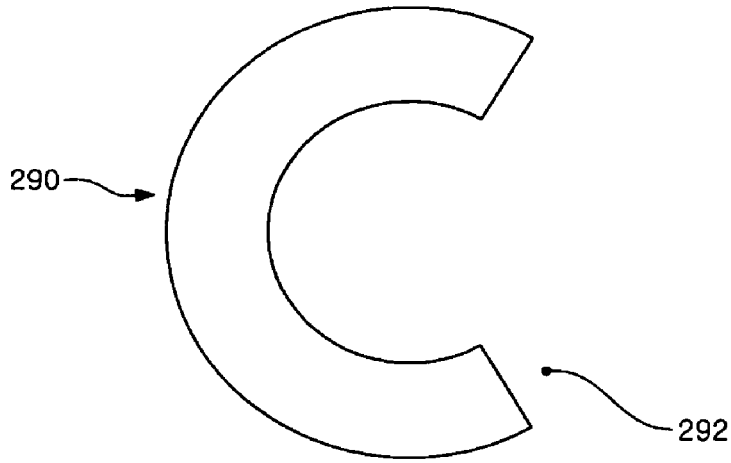
FIG. 7 is a top view showing a washer used in the second embodiment of the present invention.

Referring to FIG. 7, the washer 290 is a ring, a predetermined portion of which has been cut out, and has a predetermined thickness. The size of the cutout 292 of the washer 290 is determined so that the hinge shaft 240 can be inserted into the washer 290. When the door support plate 280 is moved upwards by the height adjustment screw 260, washers 290, the number of which corresponds to the distance between the door support plate 280 and the hinge frame 230, can be fitted between them. FIG. 6*a* shows a single washer 290 fitted between the door support plate 280 and the hinge frame 230, and FIG. 6*b* shows a number of washers 290 fitted between them after the height adjustment screw 260 has traveled a longer distance in the upward direction.

Figure 8:
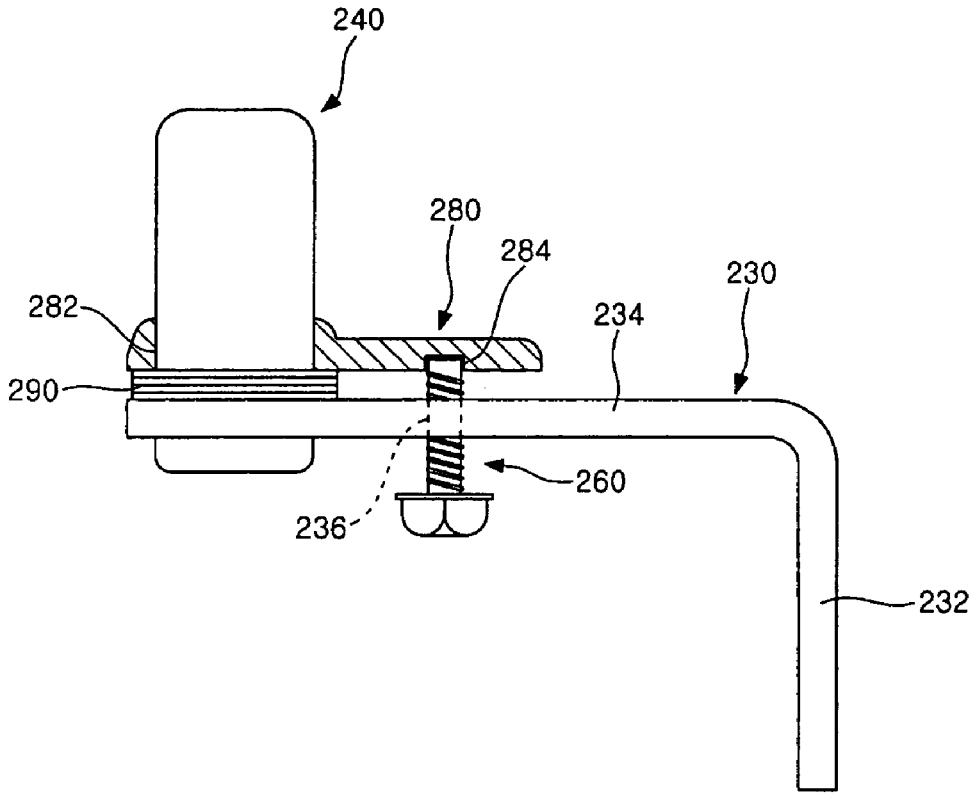
FIG. 8 is a lateral view showing an alternative hinge device according to the second embodiment of the present invention.

FIG. 8 is a lateral view showing an alternative hinge device for adjusting the height of a door of a refrigerator according to the second embodiment of the present invention. Referring to FIG. 8, the door support plate 280 has a hole 284 formed on its bottom surface so that the upper end of the height adjustment screw 260 can be partially inserted therein. When inserted into the hole 284, the upper end of the height adjustment screw 260 maintains an accurate position so that the height adjustment screw 260 can be moved upwards/downwards in a stable position. The interface between the hole 284 and the height adjustment screw 260 must has a low degree of friction and, to this end, a lubricant may be applied or a coating may be formed on the interface, for example. The hole 284 is preferably formed at the center of the door support plate 280.

A process for adjusting the height of a door of a refrigerator according to the present embodiment will now be described.

FIGS. 6*a* and 6*b* are longitudinal sectional views showing a series of height adjustment processes according to the present embodiment.

Referring to the drawings, in order to install the height adjustment device according to the present embodiment, the hinge frame 230 is fixed to the lower end of the body. The hinge shaft 240, which is integral with the support portion 234, is aligned with the through-hole 282 on the door support plate 280, which is then fitted to the hinge shaft 240. Preferably, the through-hole 282 has a smooth inner peripheral surface so that the hinge shaft 240 can easily travel upwards/downwards. The height adjustment screw 260 is coupled to the screw hole 236, which is formed on the support portion 234, so that the height adjustment screw 260 engages with the thread on the inner peripheral surface of the screw hole 236.

The door of the refrigerator is fitted to the hinge shaft 240. In this manner, the hinge device for height adjustment is installed so that the door can rotate about the hinge shaft 240. Particularly, the hinge shaft 240 acts as the center of rotation of the door, the weight of which is borne by the hinge frame 230.

When the height of the door needs to be adjusted, the height adjustment screw 260 is rotated with a tool. The rotation of the height adjustment screw 260 is converted into its upward or downward movement by the screw coupling between the thread on the outer peripheral surface of the height adjustment screw 260 and that on the inner peripheral surface of the screw hole 236. As such, the height of the door support plate 280 can be adjusted as desired by using the height adjustment screw 260. The upward/downward movement of the door support plate 280 is reflected by an upward/downward movement of the door of the refrigerator.

After adjusting the height of the door as desired, a washer 290 is inserted into a gap between the door support plate 280 and the support portion 234. The washer 290 has a cutout 292, through which it is fitted and fastened to the hinge shaft 240. As shown in FIGS. 6*a* and 6*b*, a suitable number of washers 290 are used to fill the gap between the door support plate 280 and the support portion 234. Particularly, one or a small number of washers 290 are used, when the gap is small (FIG. 6*a*), and a large number of washers 290 are used, when the gap is large (FIG. 6*b*).

In this manner, the weight of the door of the refrigerator, which is borne by the door support plate 280, is distributed to the height adjustment screw 260 and the washer 290, so that the door is stably supported. It is also possible to adjust the height of the door support plate 280 after the door is separated.

A third embodiment of the present invention will now be described.

According to the present embodiment, a door 320 for covering/uncovering a refrigerating or freezing chamber of the body of a refrigerator has a hinge unit 310 positioned below the door 320, in order to bear the weight of the door 320 and adjust its height. For example, when the refrigerating and freezing chambers of a side-by-side type refrigerator have different heights, the hinge unit 310 can be used to make them level with each other.

Figure 9:
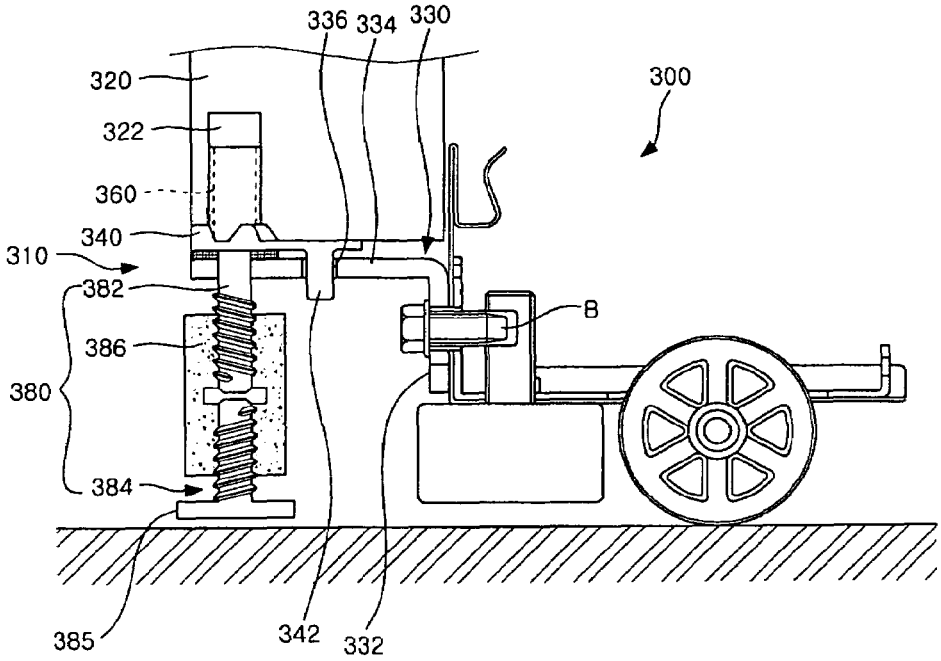
FIG. 9 is a lateral view showing a hinge device for height adjustment according to a third embodiment of the present invention.

Referring to FIG. 9, the hinge unit 310 according to the present embodiment includes a hinge frame 330 fixed to the body 300 of the refrigerator so as to bear the weight of the door 320, a height adjustment plate 340 positioned between the hinge frame 330 and the door 320 and provided with a hinge shaft 360 for rotatably supporting the door 320, and a lift unit 380 for moving the door 320 upwards/downwards via the height adjustment plate 340.

The hinge frame 330 has a fixing portion 332 fixed to the front surface of the lower end of the body 300 by a bolt B and a support portion 334 extending forwards from the upper end of the fixing portion 332. The hinge frame 330, which is fixed to the body 300 by the bolt B, rotatably supports the door 320.

The support portion 340 of the hinge frame 330 has an insertion hole 336 formed thereon so that a support protrusion 342, which extends downwards from the height adjustment plate 340, is inserted therein. The support protrusion 342 has a sectional shape corresponding to that of the insertion hole 336 and guides the height adjustment plate 340 in such a manner that it solely travels in the vertical direction.

The height adjustment plate 340 is positioned on top of the support portion 334 of the hinge frame 330. The upper and lower surfaces of the height adjustment plate 340 abut the door 320 and a lift portion 382, respectively. When the lift portion 382 is lifted, the height adjustment plate 340 travels together in the upward direction and moves the door 320 upwards. Since the support protrusion 242 is coupled to the insertion hole 336, the height adjustment plate 340 is solely allowed to travel in the vertical direction.

The hinge shaft 360 is positioned on top of the height adjustment plate 340. The hinge shaft 360 is inserted into a hinge hole 322, which extends upwards from the lower end of the door 320, and rotatably supports the door 320. The hinge shaft 360 is fixed to the top of the height adjustment plate 340 and, when inserted into the hinge hole 322, rotatably supports the door 320.

The hinge unit 310 has a lift unit 380 for lifting the height adjustment plate 340. The lift unit 380 is positioned below the height adjustment plate 340 and is adapted to extend/contract in the vertical direction.

The lift unit 380 includes a lift portion 382 having a screw portion formed on its outer peripheral edge in a direction, a support leg portion 384 having a screw portion formed on its outer peripheral edge in another direction, the support leg portion 384 being coaxially positioned with a predetermined spacing from the lift portion 382, and a lift block 386 screw-coupled to the lift portion 382 and the support leg portion 384 from outside.

The lift block 386 has a screw portion formed on its inner peripheral edge. Particularly, the lift block 386 has a female screw portion formed on the upper portion of its inner peripheral edge, which engages with the screw portion on the outer peripheral edge of the lift portion 382, and another female screw portion formed on the lower portion of the inner peripheral edge, which engages with the screw portion on the outer peripheral edge of the support leg portion 384. There exists a predetermined spacing between the lift portion 382 and the support leg portion 384, which are coaxially positioned. The screw portions on the outer peripheral edges of the lift portion 382 and the support leg portion 384, respectively, have opposite directions.

When the lift portion 382 rotates while the upper portion of the support leg portion 384 is screw-coupled to the lower portion of the lift portion 382 inside the lift block 386, the support leg portion 384 and the lift portion 382 travel in opposite directions along a single line. Particularly, rotation of the lift block 386 causes the lift portion 382 and the support leg portion 384 to approach or move away from each other.

The support leg portion 384 has a flange portion 385 formed on its lower end. The flange portion 385 extends in the radial direction and makes stable contact with the floor. The upper end of the lift portion 382 extends through the support portion of the hinge frame 330 and abuts the bottom surface of the height adjustment plate 340. Preferably, the upper end of the lift portion 382 extends in the radial direction so that the area of contact with the height adjustment plate 340 increases.

A process for adjusting the height of the door 320 according to the present embodiment, which is constructed as above, will now be described.

The height adjustment process is preformed when there is a discrepancy in height between the refrigerating and freezing chamber doors after they are assembled to the body of the refrigerator, or when one of the doors is displaced downwards after a long period of use.

For height adjustment of the door 320, the lift block 386 is rotated in a direction. Particularly, when the lift block 386 is rotated in a direction, it travels downwards due to the screw coupling with the lift portion 382. It is obvious to those skilled in the art that, in order to lower the lift block 386, the lift portion 382 must be supported in such a manner that it does not rotate. After the lift block 386 travels a predetermined distance downwards, the lower end of the support leg portion 384 reaches the floor.

Figure 10:
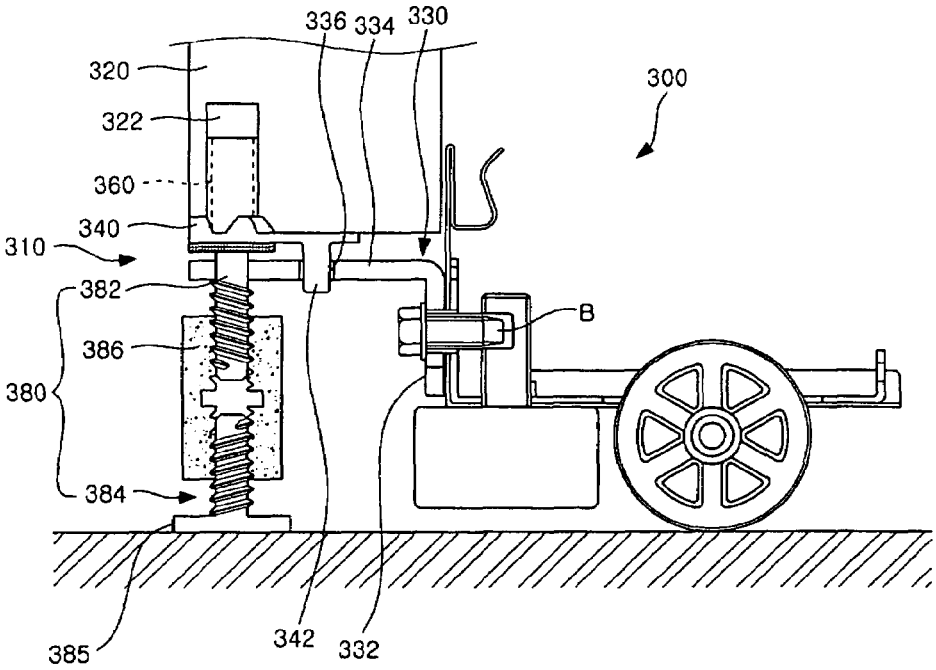
FIG. 10 is a lateral view showing a hinge device for height adjustment according to the third embodiment of the present invention, when the height of the hinge device has been adjusted.

FIG. 10 shows a state in which the lower end of the support leg portion 384 abuts the floor. When the lift block 386 is further rotated in this state, the lift portion 382 travels upwards, because the support leg portion 384 remains stationary due to friction with the floor. As a result of the upward movement of the lift portion 382, the upper end of the lift portion 382 pushes the door 320 upwards via the height adjustment plate 340.

The height adjustment plate 340 is solely allowed to travel in the vertical direction, because the support protrusion 342 of the height adjustment plate 340, which is inserted into the insertion hole 336, cannot move in the horizontal direction.

In this a process, the discrepancy in height between the refrigerating and freezing chamber doors of the refrigerator is removed (i.e. they become level with each other).

A fourth embodiment of the present invention will now be described.

Figure 11:
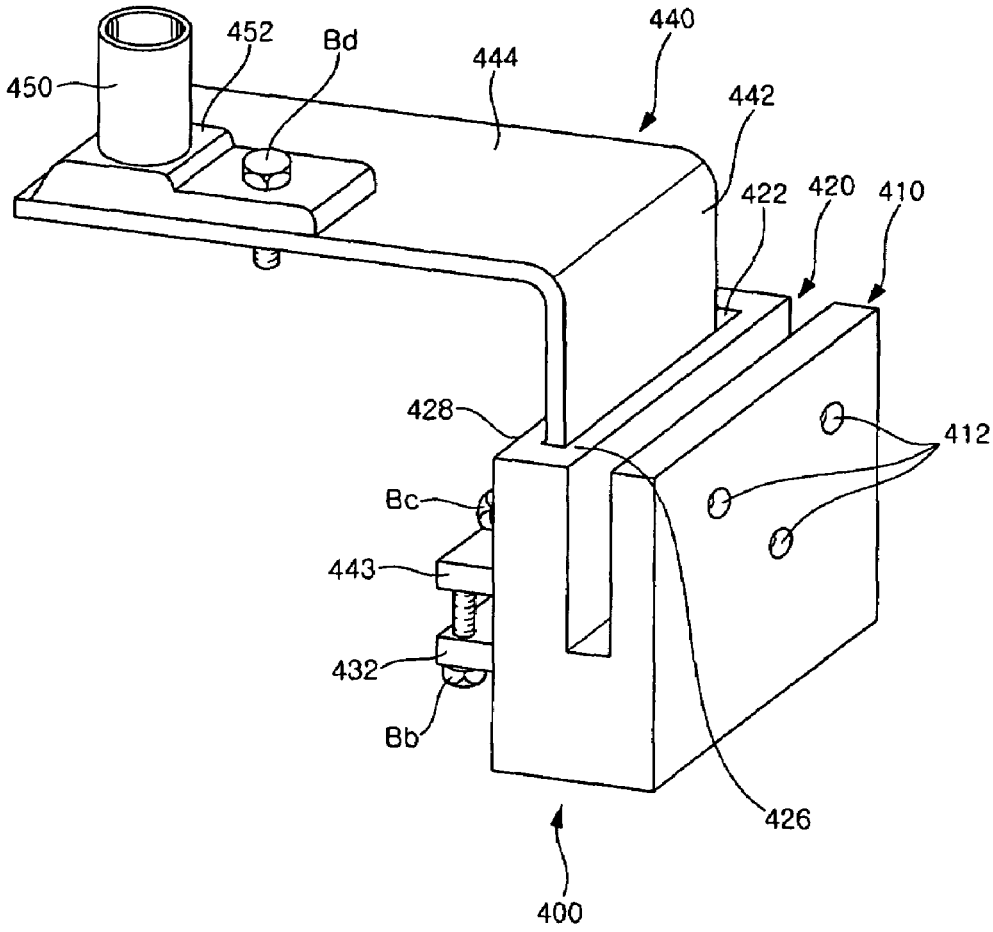
FIG. 11 is a perspective view showing a hinge device according to a fourth embodiment of the present invention.
Figure 12:
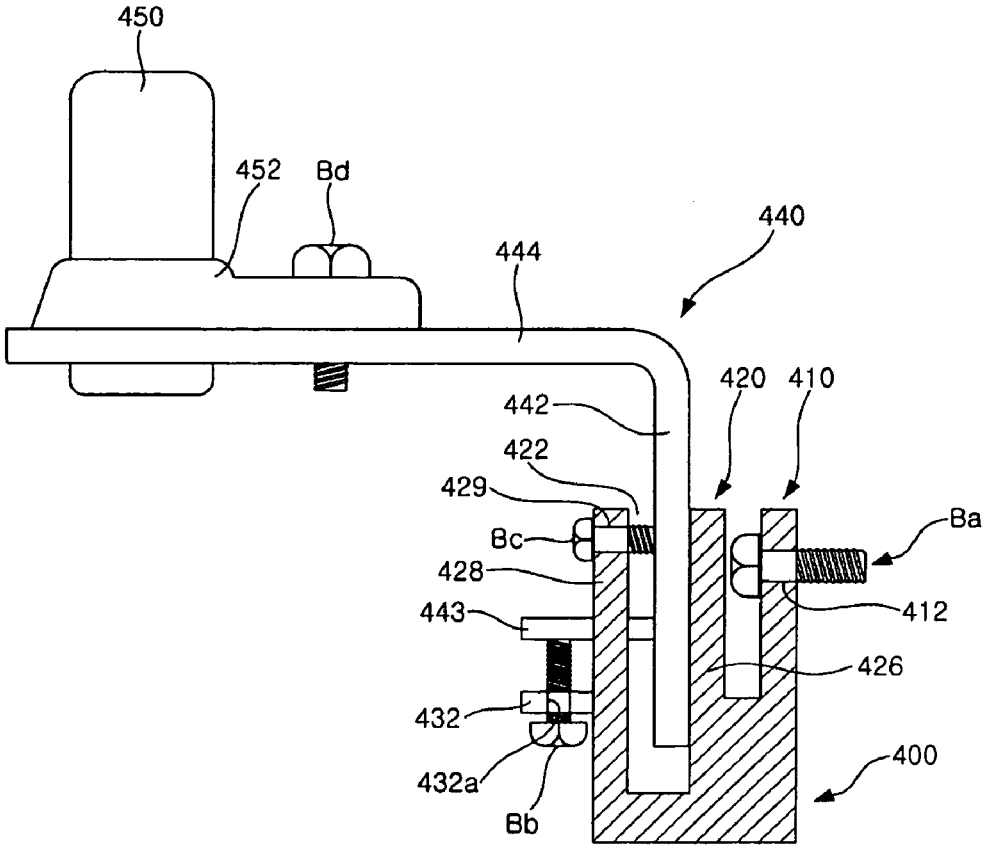
FIG. 12 is a sectional view showing a hinge device according to the fourth embodiment of the present invention.
Figure 13:
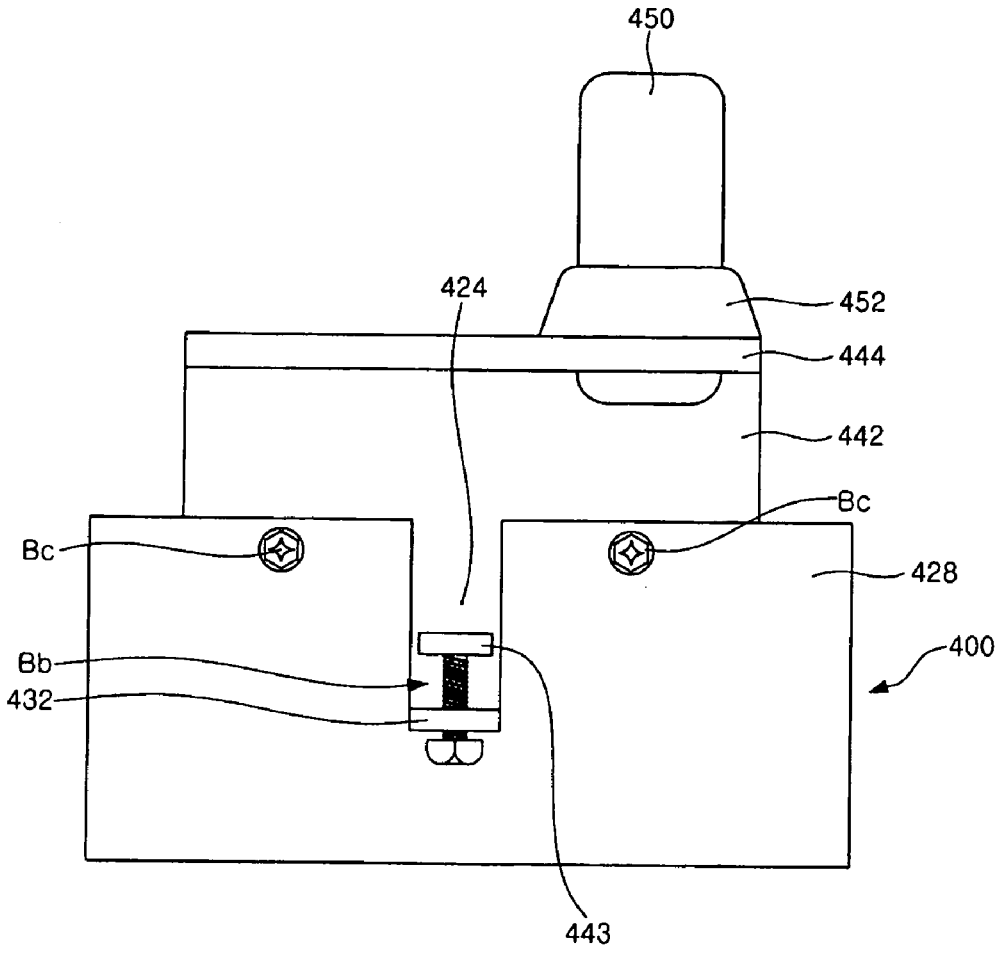
FIG. 13 is a front view showing a hinge device according to the fourth embodiment of the present invention.

FIG. 11 is a perspective view showing a hinge device according to the fourth embodiment of the present invention, FIG. 12 is a sectional view of the hinge device, and FIG. 13 is a front view thereof.

Referring to the drawings, a fixing socket 400 is fixed to a lower surface of the body of a refrigerator. The fixing socket 400 includes a fixing portion 410 having a number of fixing holes 412 to be fixed to the refrigerator and a support portion 420 positioned in front of the fixing portion 410 with a predetermined spacing between them so that a hinge bracket 440 is received and retained between them. Preferably, the fixing socket 400 is integrally formed.

A number of screws extend through the fixing holes 412 of the fixing portion 410 so that the fixing socket 400 is fixed to the front surface of the lower end of the refrigerator. Particularly, fixing bolts Ba are fixed to the front surface of the body of the refrigerator via the fixing holes 412, as shown in FIG. 12, so that the fixing socket 400 is fixed to the front surface of the refrigerator. The support portion 420, which is positioned in front of the fixing portion 410 with a predetermined spacing between them, defines a pocket portion 422, which has an upper opening so that the hinge bracket 440 is inserted and retained therein. The support portion 420 has a cutout 424 on its front surface, as shown in FIG. 13. The cutout 424 extends vertically and is open upwards.

The hinge bracket 440 is inserted into the pocket portion 422. The hinge bracket 440 has a fixing portion 442 extending vertically so as to be inserted into the pocket portion 422 and a support portion 444 extending forwards from the upper end of the fixing portion 442. When the fixing portion 442 of the hinge bracket 440 is inserted into the pocket portion 422, the hinge bracket 440 is fixed to the fixing socket 400.

The support portion 420 has front and rear portions 428 and 426, which define front and rear surfaces of the pocket portion 422, respectively. The front portion 428 of the support portion 420 has a fixing piece 432 formed at its center so as to extend horizontally. The fixing piece 432 has a screw hole 432*a* formed at its center so that an adjustment bolt Bb is screw-coupled thereto.

A height adjustment plate 443, which extends in the horizontal direction, is fixed to the front surface of the fixing portion 442 of the hinge bracket 440. The height adjustment plate 443 has a width smaller than that of the cutout 424 so that it can travel in the vertical direction inside the cutout 424. The bottom surface of the height adjustment plate 443 abuts the adjustment bolt Bb. When the adjustment bolt Bb is rotated while being screw-coupled to the fixing piece 432, it travels vertically. As a result, the upper end of the adjustment bolt Bs moves the height adjustment plate 443 in the upper or lower direction. The upward/downward movement of the height adjustment plate 443 is reflected by an upward/downward movement of the hinge bracket 440.

The front portion 428 of the support portion 420 has at least one fixing hole 429 formed near its upper end. The fixing hole 429 has a threaded inner peripheral edge so that a fastening bolt Bc is fastened thereto. This is for the purpose of maintaining the fixing portion 442 of the hinge bracket 440, which is inserted into the pocket portion 422, in a completely fixed condition.

A hinge shaft 450 is positioned on the upper surface of the support portion 444 of the hinge bracket 440. In the illustrated embodiment, the hinge shaft 450 is integrally formed with a hinge plate 452, which is fixed to the support portion 444 of the hinge bracket 440 by a fastening bolt Bd. The hinge shaft 450 is inserted into a hinge hole (not shown), which is formed on the bottom surface of the door of the refrigerator, and rotatably supports the door.

A process for adjusting the height of a door by using the hinge device according to the present embodiment will now be described.

FIG. 12 shows a state in which the fastening bolt Bc is coupled to the fixing hole 429, and an end of the fastening bolt Bc pushes the support portion 442 of the hinge bracket 440. The hinge bracket 440 is completely fastened to the rear portion 426 inside the pocket portion 422 so that the door is stably supported at a predetermined height.

In order to adjust the height of the door, the fastening bolt Bc must be unfastened. When the fastening bolt Bc is rotated and moved away from the fixing hole 429 in the forward direction, there is no supporting relationship between the fastening bolt Bc and the support portion 442 any longer. As a result, the hinge bracket 440 is allowed to travel in the vertical direction.

The bottom surface of the height adjustment plate 443 is supported by the adjustment bolt Bb. When the door is to be lowered, the adjustment bolt Bb is moved downwards.

Figure 14:
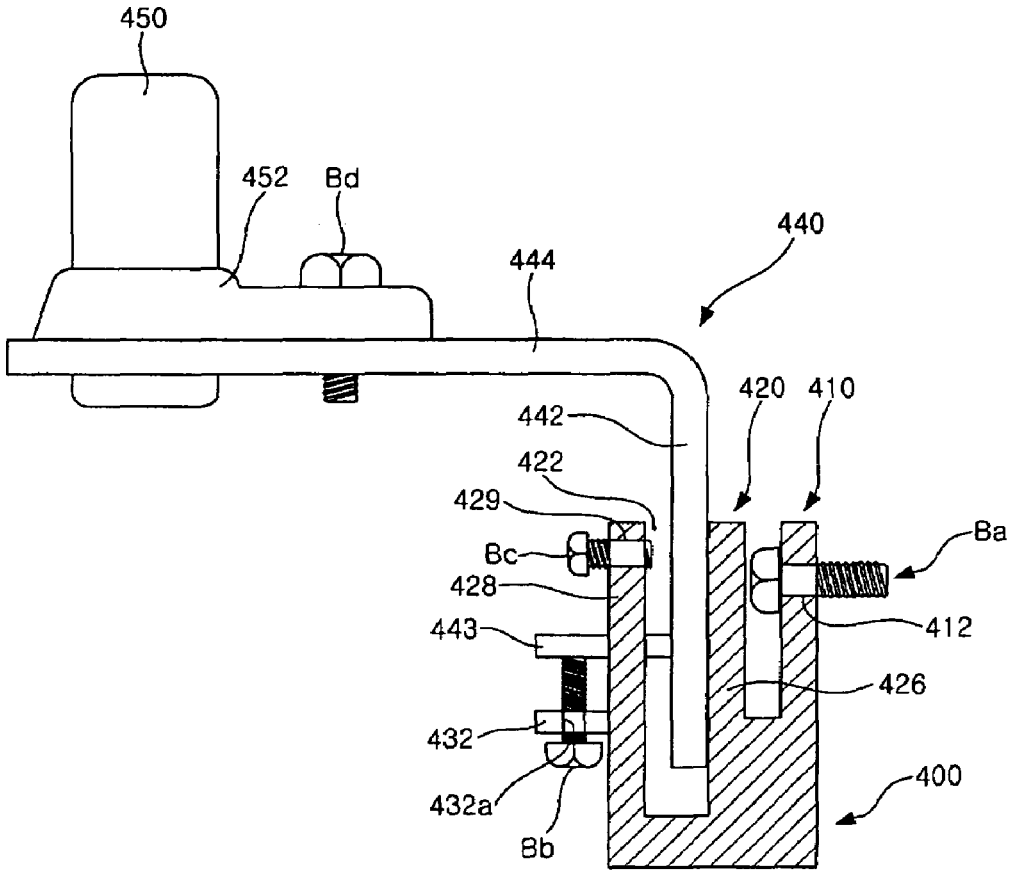
FIG. 14 is a sectional view showing a height adjustment process according to the fourth embodiment of the present invention.

When the door is to be lifted, the adjustment bolt Bb is rotated so as to move upwards. Then, the height adjustment plate 443 travels upwards together with the hinge bracket 440. As a result, the door, which is supported by the hinge shaft 450, is lifted. FIG. 14 shows a state in which the hinge bracket 440 has been lifted by the adjustment bolt Bb.

After adjusting the height of the door as desired, the fastening bolt Bc is fastened again. Particularly, the fastening bolt Bc is rotated relative to the fixing hole 429 so that it travels backwards and applies a predetermined pressure to the fixing portion 442. When the fastening bolt Bc is fully moved backwards, the fixing portion 442 is completely fastened to the rear portion 426 by the pressure from the fastening bolt Bc and is stably supported by friction force.

A hinge device according to an alternative embodiment of the present invention will now be described. Repeated description of the same components as in the fourth embodiment will be omitted, and differences will be focused on.

Figure 15:
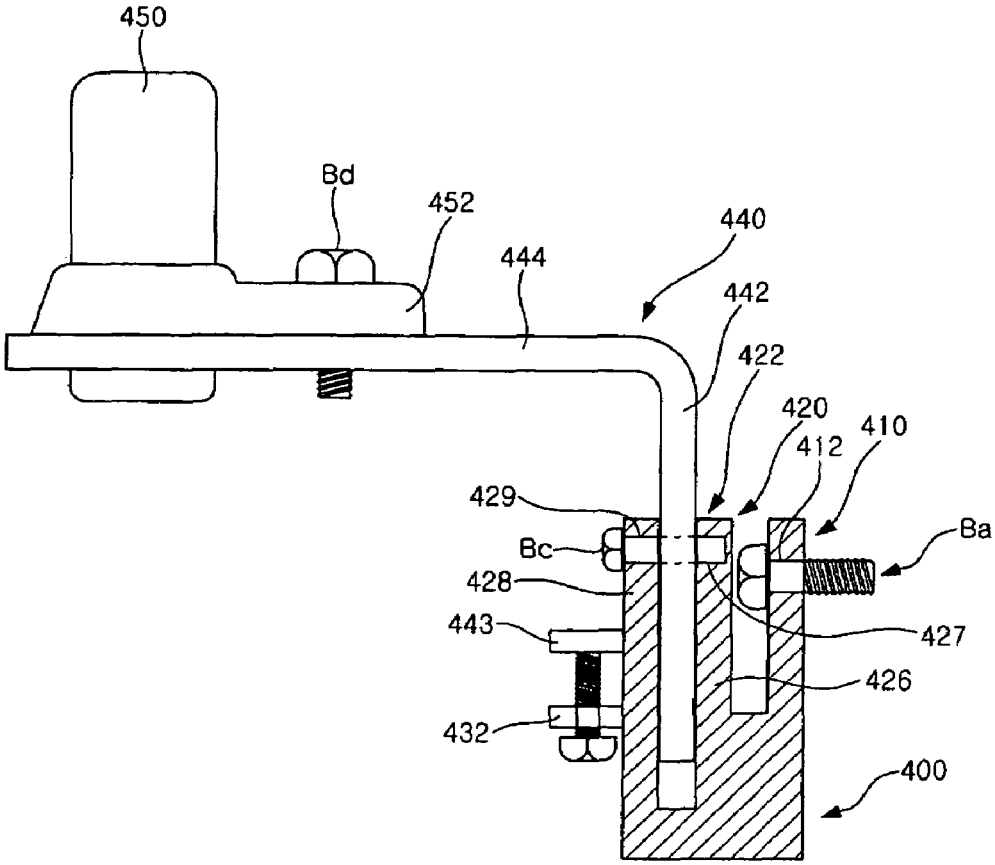
FIG. 15 is a sectional view showing a hinge device according to an alternative embodiment of the present invention.
Figure 16:
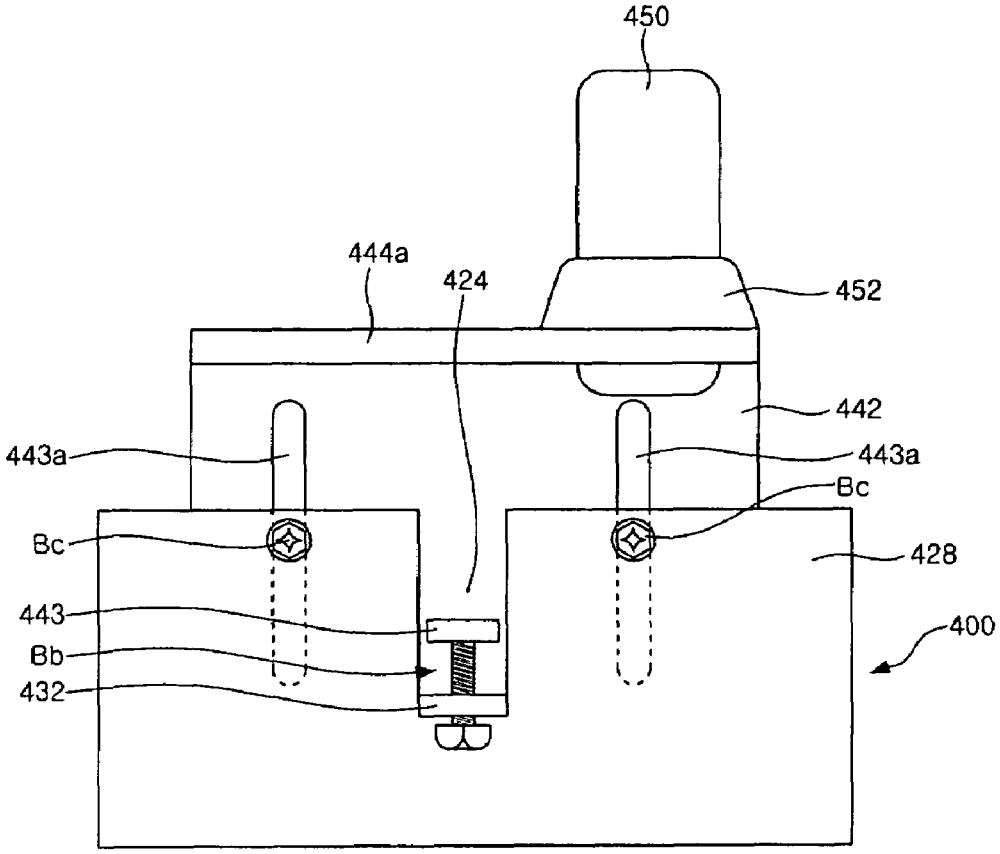
FIG. 16 is a front view showing a hinge device according to an alternative embodiment of the present invention.

FIG. 15 is a lateral sectional view showing a hinge device according to an alternative embodiment of the present invention, and FIG. 16 is a front view of the hinge device. Referring to the drawings, the hinge bracket 440 has a pair of guide holes 443*a* elongated in the vertical direction. The front portion 428 of the support portion 420, which defines the front surface of the pocket portion 422, has a pair of fixing holes 429 formed thereon. Preferably, the inner peripheral edge of the fixing holes 429 has no thread. Fastening bolts Bc are screw-coupled to the fixing holes 429. The rear portion 426 of the support portion 420, which defines the rear surface of the pocket portion 422, has a pair of fastening holes 427, which have a threaded inner peripheral edge. The fixing holes 429 of the front portion 428 are aligned with the fastening holes 427 of the rear portion 426 so that the fastening bolts Bc can extend through the respective fixing holes 429 to be coupled to the corresponding fixing holes 427 via the guide holes 443*a* of the fixing portion 442 of the hinge bracket 440.

When the adjustment screw Bb is rotated and moved upwards/downwards, the height adjustment plate 443 travels upwards/downwards accordingly. The vertical movement of the height adjustment plate 443 results in the height adjustment of the door via the hinge bracket 440.

After the height adjustment of the door via the hinge bracket 440, the fastening bolts Bc are completely fastened to the fastening holes 427. When the fastening bolts Bc are completely fastened to the fastening holes 427 via the fixing holes 429 and the guide holes 443*a*, the fixing portion 442 of the hinge bracket 440 is fastened between the front and rear portions 428 and 426 of the fixing portion 442 and remains in a fixed condition. The fastening pressure from the fastening bolts Bc are equally applied to the fixing portion 442 between the front and rear portions 428 and 426 so that the hinge bracket 440 is stably maintained. In order to efficiently transmit the fastening pressure from the fastening bolts Bc between the front and rear portions 428 and 426 and the fixing portion 442, the horizontal spacing of the pocket portion 422 between the front and rear portions 428 and 426 must be properly determined. Preferably, the horizontal spacing of the pocket portion 422 is slightly larger than the thickness of the fixing portion 422 of the hinge bracket 440 so that fastening force is applied most easily when the fixing portion 442 is inserted therein.

When the fastening bolts Bc are unfastened, the hinge bracket 440 is allowed to move in the vertical direction. By rotating the adjustment bolt Bb so that it is moved in the vertical direction, the height adjustment plate 443 is lifted/lowered. This means that the door, which is inserted into the hinge shaft 450, can be lifted/lowered by using the hinge bracket 440. After the height of the door is adjusted as desired, the fastening bolts Bc are completely fastened to the fastening hole 427. Then, the fixing portion 442 of the hinge bracket 440 is completely fixed to the pocket portion 422 and supports the door.

According to the alternative embodiment, the weight of the door is borne by the friction force between both surfaces of the fixing portion 442 of the hinge bracket 442 and the front and rear portions 428 and 426, respectively, so that the door is supported more stably.

As mentioned above, the present invention is advantageous in that the height of a door of a refrigerator can be adjusted easily. When the door is displaced downwards after a long period of use, its height can be adjusted properly. Particularly, this improves the reliability of a side-by-side type refrigerator.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A refrigerator having a height-adjustable door, comprising:

a body having at least one storage space formed therein, the at least one storage space having a front opening;

a door coupled to the body so as to cover/uncover the front opening of the at least one storage space, a hinge hole being formed in a bottom surface of the door;

a hinge frame fixed to a front surface of a lower portion of the body;

a stationary hinge shaft extending upward from the hinge frame and configured to be inserted into the hinge hole so as to rotatably support the door;

a door support plate separate from the hinge frame and slidably coupled to the hinge shaft such that the hinge shaft extends through a shaft hole in the door support plate and into the hinge hole, wherein the support plate abuts the bottom surface of the door; and a height adjustment screw that rotatably extends through a screw hole in the hinge frame, at a position that is spaced apart from the hinge shaft, wherein a distal end of the height adjustment screw contacts a lower surface of the door support plate such that the door support plate is lifted/lowered as the height adjustment screw rotates in the screw hole and travels upwards/downwards.

2. The refrigerator as claimed in claim 1, further comprising at least one washer fitted to the hinge shaft, at a position between the door support plate and the hinge frame.

3. The refrigerator as claimed in claim 2, wherein the hinge frame has a fixing portion that is fixed to the front surface of the lower portion of the body, and a support portion that extends forward from an upper end of the fixing portion, wherein the hinge shaft extends upward from the support portion, and the height adjustment screw is rotatably coupled to the support portion through the screw hole formed in the support portion.

4. The refrigerator as claimed in claim 3, further comprising a receiving hole formed in the bottom surface of the door support plate, wherein the receiving hole receives the distal end of the height adjustment screw therein.

5. The refrigerator as claimed in claim 1, wherein the hinge shaft is fixed to the hinge frame.

6. The refrigerator as claimed in claim 1, wherein the hinge shaft is integral with the hinge frame.

7. The refrigerator as claimed in claim 2, wherein the at least one washer has a cutout portion.

8. The refrigerator as claimed in claim 7, wherein the cutout portion is configured such that the hinge shaft can pass through the cutout portion as the washer is mounted on the hinge shaft.

9. The refrigerator as claimed in claim 2, wherein the at least one washer comprises a plurality of washers.

10. A refrigerator, comprising:

a body having at least one storage space therein, wherein the storage space has an opening;

a door that is hinge coupled to the body so that the door can cover/uncover the storage space;

a hinge frame coupled to the body;

a hinge shaft that extends upward from the hinge frame, wherein the hinge shaft is inserted into a hinge hole formed in a bottom surface of the door;

a door support plate that is movably coupled to the hinge frame and the hinge shaft, wherein an upper surface of the door support plate abuts and supports the bottom surface of the door; and a height adjustment screw that is screwed into a threaded hole in the hinge frame, at a position that is spaced apart from the hinge shaft, wherein a distal end of the height adjustment screw abuts a bottom surface of the door support plate, and raises/lowers the door support plate and the door as it rotates within the threaded hole.

11. The refrigerator as claimed in claim 10, wherein the hinge shaft is integral with the hinge frame.

12. The refrigerator as claimed in claim 10, further comprising at least one washer that is mounted around the hinge shaft and positioned between the hinge frame and the door support plate.

13. The refrigerator as claimed in claim 12, wherein the at least one washer has a cutout portion that allows the hinge shaft to pass through the cutout portion as the washer is mounted around the hinge shaft.

14. The refrigerator as claimed in claim 10, wherein a receiving recess is formed on a bottom surface of the door support plate, and wherein the distal end of the height adjustment screw is received in the receiving recess.

* * * * *